US005345078A

United States Patent [19]

Kelley

[11] Patent Number: 5,345,078

[45] Date of Patent: Sep. 6, 1994

[54] MASS SPECTROMETRY METHOD USING NOTCH FILTER

[75] Inventor: Paul E. Kelley, San Jose, Calif.

[73] Assignee: Teledyne MEC, Mountain View, Calif.

[21] Appl. No.: 90,474

[22] Filed: Jul. 12, 1993

Related U.S. Application Data

[63] Continuation of Ser. No. 920,953, Jul. 27, 1993, abandoned, which is a continuation of Ser. No. 662,217, Feb. 28, 1991, Pat. No. 5,134,286.

[51] Int. Cl.[5] ..... H01J 49/42

[52] U.S. Cl. ..... 250/282; 250/290; 250/292

[58] Field of Search ..... 250/282, 281, 290, 291, 250/292, 293

[56] References Cited

U.S. PATENT DOCUMENTS

| | | | |
|---|---|---|---|
| 2,939,952 | 6/1960 | Paul et al. | 250/292 |
| 3,334,225 | 8/1967 | Langmuir | 250/292 |
| 5,105,081 | 4/1992 | Kelley | 250/282 |
| 5,134,286 | 7/1992 | Kelley | 250/282 |

*Primary Examiner*—Jack I. Berman
*Assistant Examiner*—James Beyer
*Attorney, Agent, or Firm*—Limbach & Limbach

[57] ABSTRACT

A mass spectrometry method in which notch-filtered noise is applied to an ion trap to resonate all ions except selected parent ions out of the region of the trapping field. Preferably, the trapping field is a quadrupole trapping field defined by a ring electrode and a pair of end electrodes positioned symmetrically along a z-axis, and the filtered noise is applied to the ring electrode (rather than to the end electrodes) to eject unwanted ions in radial directions (toward the ring electrode) rather than toward a detector mounted along the z-axis. Application of the filtered noise to the trap in this manner can significantly increase the operating lifetime of such an ion detector. Also preferably, the trapping field has a DC component selected so that the trapping field has both a high frequency and low frequency cutoff, and is incapable of trapping ions with resonant frequency below the low frequency cutoff or above the high frequency cutoff. Application of the filtered noise signal of the invention to such a trapping field is functionally equivalent to filtration of the trapped ions through a notched bandpass filter having such high and low frequency cutoffs. Application of filtered noise in accordance with the invention has several significant advantages over the conventional techniques it replaces, including avoidance of accumulation of contaminating ions during the process of storing desired parent ions, ejection of unwanted ions in directions away from an ion detector to enhance the detector's operating life, rapid ejection of unwanted ions having mass-to-charge ratio below a minimum value, above a maximum value, and outside a window (between the minimum and maximum values) determined by the filtered noise signal.

1 Claim, 2 Drawing Sheets

MASS SPECTROMETRY METHOD USING NOTCH FILTER

This is a continuation of co-pending application Ser. No. 07/920,953 filed on Jul. 27, 1992, now abandoned which in turn is a continuation of U.S. application Ser. No. 07/662,217, filed Feb. 28, 1991 (issued as U.S. Pat. 5,134,286).

FIELD OF THE INVENTION

The invention relates to mass spectrometry methods in which parent ions are stored in an ion trap. More particularly, the invention is a mass spectrometry method in which notch filtered noise is applied to an ion trap to eject ions other than selected parent ions from the trap.

BACKGROUND OF THE INVENTION

In a class of conventional mass spectrometry techniques known as "MS/MS" methods, ions (known as "parent ions") having mass-to-charge ratio within a selected range are stored in an ion trap. The trapped parent ions are then allowed, or induced, to dissociate (for example, by colliding with background gas molecules within the trap) to produce ions known as "daughter ions." The daughter ions are then ejected from the trap and detected.

For example, U.S. Pat. No. 4,736,101, issued Apr. 5, 1988, to Syka, et al., discloses an MS/MS method in which ions (having a mass-to-charge ratio within a predetermined range) are trapped within a three-quadrupole trapping field. The trapping field is then scanned to eject unwanted parent ions (ions other than parent ions having a desired mass-to-charge ratio) sequentially from the trap. The trapping field is then changed again to become capable of storing daughter ions of interest. The trapped parent ions are then induced to dissociate to produce daughter ions, and the daughter ions are ejected sequentially from the trap for detection.

In order to eject unwanted parent ions from the trap prior to parent ion dissociation, U.S. Pat. No. 4,736,101 teaches that the trapping field should be scanned by sweeping the amplitude of the fundamental voltage which defines the trapping field.

U.S. Pat. No. 4,736,101 also teaches that a supplemental AC field can be applied to the trap during the period in which the parent ions undergo dissociation, in order to promote the dissociation process (see column 5, lines 43–62), or to eject a particular ion from the trap so that the ejected ion will not be detected during subsequent ejection and detection of sample ions (see column 4, line 60, through column 5, line 6).

U.S. Pat. No. 4,736,101 also suggests (at column 5, lines 7–12) that a supplemental AC field could be applied to the trap during an initial ionization period, to eject a particular ion (especially an ion that would otherwise be present in large quantities) that would otherwise interfere with the study of other (less common) ions of interest.

European Patent Application 362,432 (published Apr. 11, 1990) discloses (for example, at column 3, line 56 through column 4, line 3) that a broad frequency band signal ("broadband signal") can be applied to the end electrodes of a quadrupole ion trap to simultaneously resonate all unwanted ions out of the trap (through the end electrodes) during a sample ion storage step. EPA 362,432 teaches that the broadband signal can be applied to eliminate unwanted primary ions as a preliminary step to a chemical ionization operation, and that the amplitude of the broadband signal should be in the range from about 0.1 volts to 100 volts.

SUMMARY OF THE INVENTION

The invention is a mass spectrometry method in which a broadband signal (noise having a broad frequency spectrum) is applied through a notch filter to an ion trap to resonate all ions except selected parent ions out of the trap. Such a notch-filtered broadband signal will be denoted herein as a "filtered noise" signal.

Preferably, the trapping field is a quadrupole trapping field defined by a ring electrode and a pair of end electrodes positioned symmetrically along a z-axis, and the filtered noise is applied to the ring electrode (rather than to the end electrodes) to eject unwanted ions in a radial direction (toward the ring electrode) rather than in the z-direction toward a detector mounted along the z-axis. Application of the filtered noise to the trap in this manner can significantly increase the operating lifetime of such an ion detector.

Also preferably, the trapping field has a DC component selected so that the trapping field has both a high frequency and low frequency cutoff, and is incapable of trapping ions with resonant frequency below the low frequency cutoff or above the high frequency cutoff. Application of the inventive filtered noise signal to such a trapping field is functionally equivalent to filtration of the trapped ions through a notched bandpass filter having such high and low frequency cutoffs.

Application of filtered noise in accordance with the invention has several significant advantages over the conventional techniques it replaces. In all embodiments of the inventive method, a filtered noise signal is applied to rapidly resonate all ions out of a trap, except for parent ions having a mass-to-charge ratio within a selected range (occupying a small "window" determined by the notch in the notch filter). In prior art techniques in which the trapping field is scanned to eject ions other than those having a selected mass-to-charge ratio, the scanning operation requires much more time than does filtered noise application in accordance with the invention. During the lengthy duration of such a prior art field scan, contaminating ions may unavoidably be produced in the trap, and yet many of these contaminating ions will not experience field conditions adequate to eject them from the trap. The inventive filtered noise application operation avoids accumulation of such contaminating ions.

The invention also enables ejection of unwanted ions in directions away from an ion detector to enhance the detector's operating life, and enables rapid ejection of unwanted ions having mass-to-charge ratio below a minimum value, above a maximum value, and outside a window (between the minimum and maximum values) determined by the filtered noise signal.

In one embodiment, after the filtered noise is applied to the trap and selected parent ions have been stored in the trap (and unwanted ions have been ejected), a supplemental AC field is applied to the trap to induce the stored parent ions to dissociate. The resulting daughter ions are stored in the trap, and are later detected by an in-trap or out-of-trap detector.

DETAILED DESCRIPTION OF THE PREFERRED EMBODIMENTS

Figure 1:
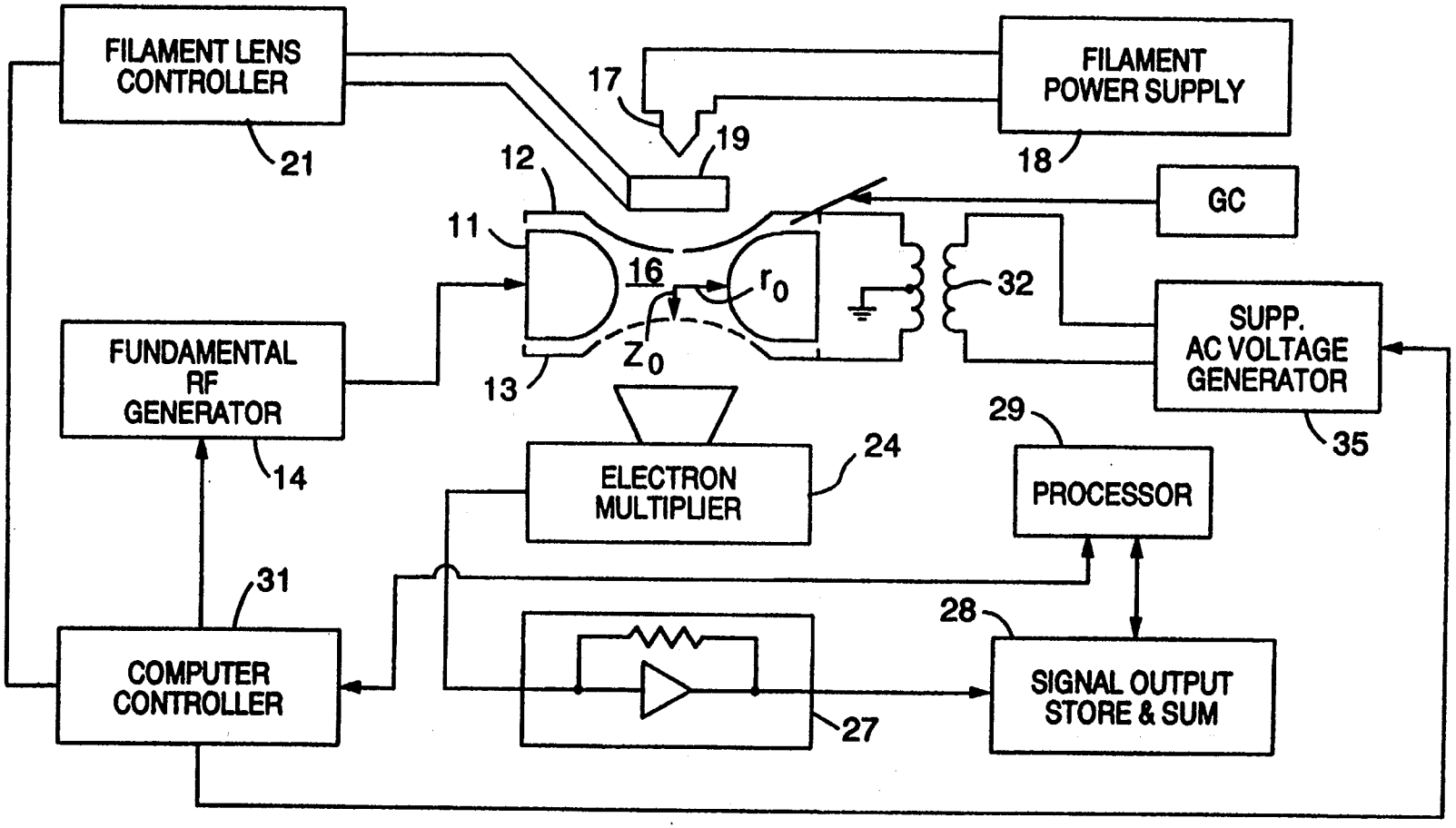
FIG. 1 is a simplified schematic diagram of an apparatus useful for implementing a class of preferred embodiments of the invention.

The quadrupole ion trap apparatus shown in FIG. 1 is useful for implementing a class of preferred embodiments of the invention. The FIG. 1 apparatus includes ring electrode 11 and end electrodes 12 and 13. A three-dimensional quadrupole trapping field is produced in region 16 enclosed by electrodes 11–13, when fundamental voltage generator 14 is switched on to apply a fundamental RF voltage (having a radio frequency component and optionally also a DC component) between electrode 11 and electrodes 12 and 13. Ion storage region 16 has dimension $z_o$ in the z-direction (the vertical direction in FIG. 1) and radius $r_o$ (in a radial direction from the z-axis through the center of ring electrode 11 to the inner surface of ring electrode 11). Electrodes 11, 12, and 13 are common mode grounded through coupling transformer 32.

Supplemental AC voltage generator 35 can be switched on to apply a desired supplemental AC voltage signal (such as the inventive filtered noise signal) across end electrodes 12 and 13. The supplemental AC voltage signal is selected (in a manner to be explained below in detail) to resonate desired trapped ions at their axial resonance frequencies. Alternatively, supplemental AC voltage generator 35 (or a second AC voltage generator, not shown in FIG. 1) can be connected, between ring electrode 11 and ground, to apply a desired notch filtered noise signal to ring electrode 11 to resonate unwanted ions (at their radial resonance frequencies) out of the trap in radial directions.

Filament 17, when powered by filament power supply 18, directs an ionizing electron beam into region 16 through an aperture in end electrode 12. The electron beam ionizes sample molecules within region 16, so that the resulting ions can be trapped within region 16 by the quadrupole trapping field. Cylindrical gate electrode and lens 19 is controlled by filament lens control circuit 21 to gate the electron beam off and on as desired.

In one embodiment, end electrode 13 has perforations 23 through which ions can be ejected from region 16 (in the z-direction) for detection by an externally positioned electron multiplier detector 24. Electrometer 27 receives the current signal asserted at the output of detector 24, and converts it to a voltage signal, which is summed and stored within circuit 28, for processing within processor 29.

In a variation on the FIG. 1 apparatus, perforations 23 are omitted, and an in-trap detector is substituted. Such an in-trap detector can comprise the trap's end electrodes themselves. For example, one or both of the end electrodes could be composed of (or partially composed of) phosphorescent material which emits photons in response to incidence of ions at one of its surfaces. In another class of embodiments, the in-trap ion detector is distinct from the end electrodes, but is mounted integrally with one or both of them (so as to detect ions that strike the end electrodes without introducing significant distortions in the shape of the end electrode surfaces which face region 16). One example of this type of in-trap ion detector is a Faraday effect detector in which an electrically isolated conductive pin is mounted with its tip flush with an end electrode surface (preferably at a location along the z-axis in the center of end electrode 13). Alternatively, other kinds of in-trap ion detection means can be employed, such as an ion detection means capable of detecting resonantly excited ions that do not directly strike it (examples of this latter type of detection means include resonant power absorption detection means, and image current detection means). The output of each in-trap detector is supplied through appropriate detector electronics to processor 29.

Control circuit 31 generates control signals for controlling fundamental voltage generator 14, filament control circuit 21, and supplemental AC voltage generator 35. Circuit 31 sends control signals to circuits 14, 21, and 35 in response to commands it receives from processor 29, and sends data to processor 29 in response to requests from processor 29.

Figure 2:
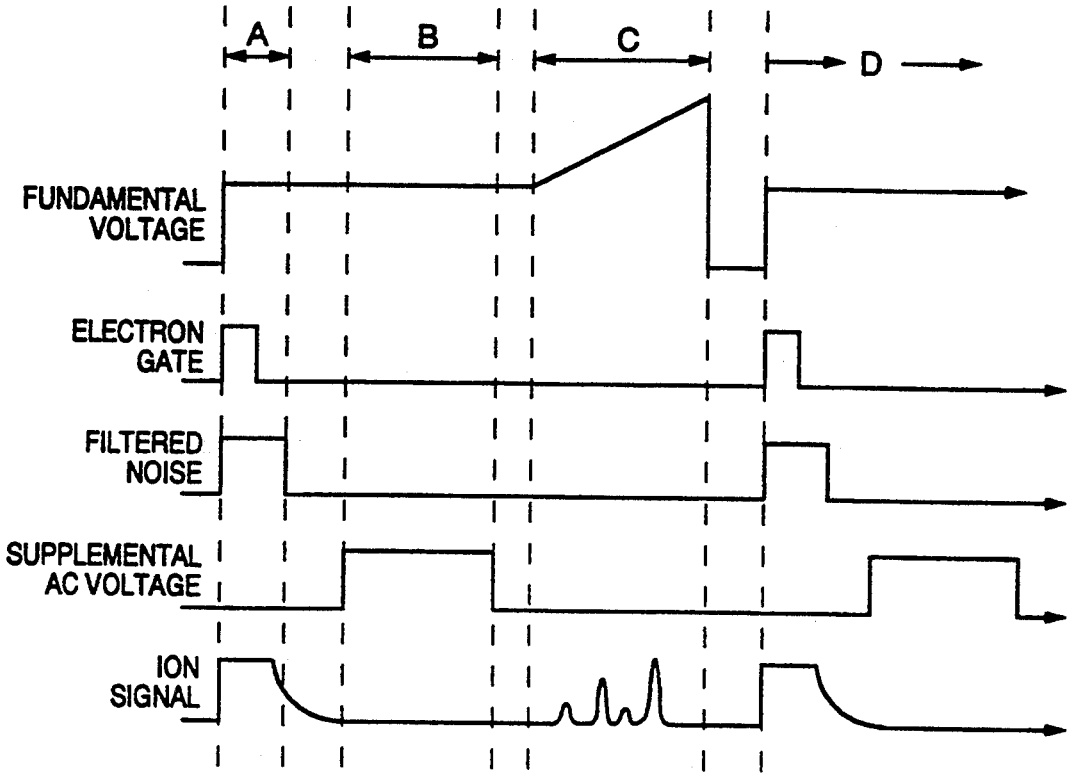
FIG. 2 is a diagram representing signals generated during performance of a first preferred embodiment of the invention.

A first preferred embodiment of the inventive method will next be described with reference to FIG. 2. As indicated in FIG. 2, the first step of this method (which occurs during period "A") is to store parent ions in a trap. This can be accomplished by applying a fundamental voltage signal to the trap (by activating generator 14 of the FIG. 1 apparatus) to establish a quadrupole trapping field, and introducing an ionizing electron beam into ion storage region 16. Alternatively, the parent ions can be externally produced and then injected into storage region 16.

The fundamental voltage signal is chosen so that the trapping field will store (within region 16) parent ions (such as parent ions resulting from interactions between sample molecules and the ionizing electron beam) as well as daughter ions (which may be produced during period "B") having mass-to-charge ratio within a desired range. The fundamental voltage signal has an RF component, and preferably also has a DC component whose amplitude is chosen to cause the trapping field to have both a high frequency cutoff and a low frequency cutoff for the ions it is capable of storing. Such low frequency cutoff and high frequency cutoff correspond, respectively (and in a well-known manner), to a particular maximum and minimum mass-to-charge ratio.

Figure 3:
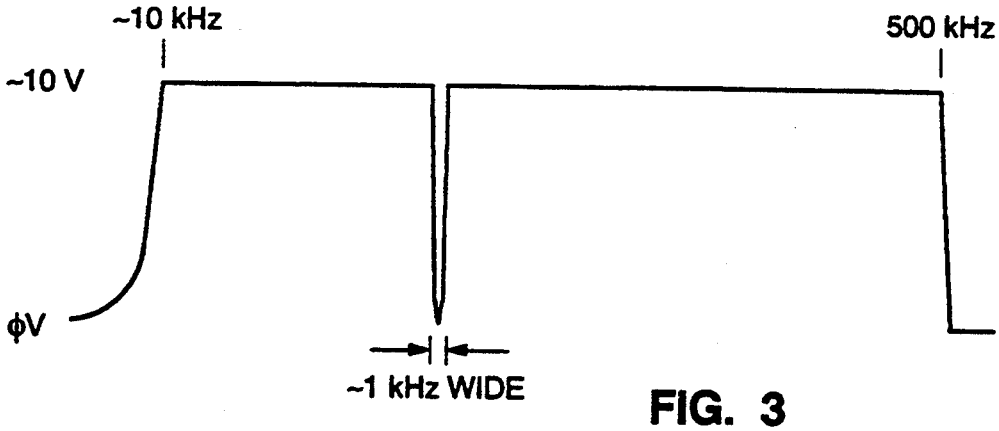
FIG. 3 is a graph representing a preferred embodiment of the notch-filtered broadband signal applied during performance of the invention.

Also during step A, a notch-filtered broadband noise signal (the "filtered noise" signal in FIG. 2) is applied to the trap. FIG. 3 represents the frequency-amplitude spectrum of a preferred embodiment of such filtered noise signal, for use in the case that the RF component of the fundamental voltage signal applied to ring electrode 11 has a frequency of 1.0 MHz, and the case that the fundamental voltage signal has a non-optimal DC component (for example, no DC component at all). The phrase "optimal DC component" will be explained below. As indicated in FIG. 3, the bandwidth of the filtered noise signal extends from about 10 kHz to about 500 kHz (with components of increasing frequency corresponding to ions of decreasing mass to-charge ratio). There is a notch (having width approximately equal to 1 kHz) in the filtered noise signal at a frequency (between 10 kHz and 500 kHz) corresponding to the axial resonance frequency of a particular parent ion to be stored in the trap.

Alternatively, the inventive filtered noise signal can have a notch corresponding to the radial resonance frequency of a parent ion to be stored in the trap (this is useful in a class of embodiments to be discussed below in which the filtered noise signal is applied to the ring electrode of a quadrupole ion trap rather than to the end electrodes of such a trap), or it can have two or more notches, each corresponding to the resonance frequency (axial or radial) of a different parent ion to be stored in the trap.

In the case that the fundamental voltage signal has an optimal DC component (i.e., a DC component chosen to establish both a desired low frequency cutoff and a desired high frequency cutoff for the trapping field), a filtered noise signal with a narrower frequency bandwidth than that shown in FIG. 3 can be employed during performance of the invention. Such a narrower bandwidth filtered noise signal is adequate (assuming an optimal DC component is applied) since ions having mass-to-charge ratio above the maximum mass-to-charge ratio which corresponds to the low frequency cutoff will not have stable trajectories within the trap region, and thus will escape the trap even without application of any filtered noise signal. A filtered noise signal having a minimum frequency component substantially above 10 kHz (for example, 100 kHz) will typically be adequate to resonate unwanted parent ions from the trap, if the fundamental voltage signal has an optimal DC component.

Ions produced in (or injected into) trap region 16 during period A which have a mass-to-charge ratio outside the desired range (determined by the combination of the filtered noise signal and the fundamental voltage signal) will escape from region 16, possibly saturating detector 24 as they escape, as indicated by the value of the "ion signal" in FIG. 2 during period A.

Before the end of period A, the ionizing electron beam is gated off.

After period A, during period B, a supplemental AC voltage signal is applied to the trap (such as by activating generator 35 of the FIG. 1 apparatus or a second supplemental AC voltage generator connected to the appropriate electrode or electrodes). The amplitude (output voltage applied) of the supplemental AC signal is lower than that of the filtered noise signal (typically, the amplitude of the supplemental AC signal is on the order of 100 mV while the amplitude of the filtered noise signal is on the order of 10 V). The supplemental AC voltage signal has a frequency selected to induce dissociation of a particular parent ion (to produce daughter ions therefrom), but has amplitude (and hence power) sufficiently low that it does not resonate significant numbers of the ions excited thereby to a degree sufficient for in-trap or out of-trap detection.

Next, during period C, the daughter ions are sequentially detected. This can be accomplished, as suggested by FIG. 2, by scanning the amplitude of the RF component of the fundamental voltage signal (or both the amplitude of the RF and the DC components of the fundamental voltage signal) to successively eject daughter ions having different mass-to-charge ratios from the trap for detection outside the trap (for example, by electron multiplier 24 shown in FIG. 1). The "ion signal" portion shown within period C of FIG. 2 has four peaks, each representing sequentially detected daughter ions having a different mass-to-charge ratio.

If out-of-trap daughter ion detection is employed during period C, the daughter ions are preferably ejected from the trap in the z-direction toward a detector (such as electron multiplier 24) positioned along the z-axis. This can be accomplished using a sum resonance technique, a mass selective instability ejection technique, a resonance ejection technique in which a combined trapping field and supplementary AC field is swept or scanned to eject daughter ions successively from the trap in the z direction), or by some other ion ejection technique.

If in-trap detection is employed during period C, the daughter ions are preferably detected by an in-trap detector positioned at the location of one or both of the trap's end electrodes (and preferably centered about the z-axis). Examples of such in-trap detectors have been discussed above.

To enhance the operating lifetime of an in-trap or out-of-trap detector positioned along the z-axis (or at the end electrodes), the unwanted ions resonated out of the trap during period A (by the filtered noise signal) should be ejected in radial directions (toward the ring electrode; not the end electrodes) so that they do not strike the detector during step A. As indicated above with reference to FIG. 1, this can be accomplished by applying the filtered noise signal to the ring electrode of a quadrupole ion trap to resonate unwanted parent ions (at their radial resonance frequencies) out of the trap in radial directions (away from the detector).

During the period which immediately follows period C, all voltage signal sources (and the ionizing electron beam) are switched off. The inventive method can then be repeated (i.e., during period D in FIG. 2).

In a variation on the FIG. 2 method, the supplemental AC voltage signal has two or more different frequency components within a selected frequency range. Each such frequency component should have frequency and amplitude characteristics of the type described above with reference to FIG. 2.

One class of embodiments of the invention includes variations on the FIG. 2 method in which additional generations of daughter ions (such as granddaughter ions, or other products, of the daughter ions mentioned above) are isolated in a trap and then detected. For example, after step B in the FIG. 2 method, filtered noise can again be applied to the trap to eject all ions other than selected daughter ions (i.e., daughter ions having mass-to-charge ratios within a desired range). The daughter ions isolated in the trap can then be allowed to dissociate (or induced to dissociate) to produce granddaughter ions, and the granddaughter ions can then be sequentially detected during step C.

For example, during step B in the FIG. 2 method, the supplemental AC voltage signal can consist of an earlier portion followed by a later portion: the earlier portion having frequency selected to induce production of a daughter ion (by dissociating a parent ion); and the later portion having frequency selected to induce production of a granddaughter ion (by dissociating the daughter ion). Between application of such earlier and later portions, a filtered noise signal can be applied to resonate ions other than the daughter ion from the trap.

In the claims, the phrase "daughter ion" is intended to denote granddaughter ions (second generation daughter ions) and subsequent (third or later) generation daughter ions, as well as "first generation" daughter ions.

Various other modifications and variations of the described method of the invention will be apparent to those skilled in the art without departing from the scope and spirit of the invention. Although the invention has been described in connection with specific preferred embodiments, it should be understood that the invention as claimed should not be unduly limited to such specific embodiments.

What is claimed is:

1. A mass spectrometry method, including the steps of:

(a) establishing a three-dimensional trapping field capable of storing parent ions and daughter ions having mass-to-charge ratio within a selected range within a three-dimensional trap volume bounded by a set of electrodes;

(b) applying a filtered noise signal to at least one of the electrodes to resonate out of the trap volume unwanted ions having mass-to-charge ratio within a second selected range.

* * * * *